US006643112B1

(12) United States Patent
Carton et al.

(10) Patent No.: US 6,643,112 B1
(45) Date of Patent: Nov. 4, 2003

(54) SEMICONDUCTOR SWITCH-ASSISTED ELECTROMECHANICAL RELAY

(75) Inventors: Hervé Carton, Livron S/Drome (FR); Denis Flandin, Bourg de Peage (FR)

(73) Assignee: Crouzet Automatismes, Valence (FR)

( * ) Notice: Subject to any disclaimer, the term of this patent is extended or adjusted under 35 U.S.C. 154(b) by 0 days.

(21) Appl. No.: 09/762,299

(22) PCT Filed: May 19, 2000

(86) PCT No.: PCT/FR00/01378

§ 371 (c)(1),
(2), (4) Date: Feb. 8, 2001

(87) PCT Pub. No.: WO00/75947

PCT Pub. Date: Dec. 14, 2000

(30) Foreign Application Priority Data

Jun. 8, 1999 (FR) ..... 99 07218

(51) Int. Cl.[7] ..... H01H 47/00

(52) U.S. Cl. ..... 361/152; 361/2; 361/3; 361/8; 361/13; 361/172; 218/3; 218/7

(58) Field of Search ..... 361/2, 3, 7, 14, 361/152, 160, 170–172, 189, 190; 218/2, 3, 6, 7, 17

(56) References Cited

U.S. PATENT DOCUMENTS 4,420,784 A * 12/1983 Chen et al. ..... 361/13
4,618,906 A 10/1986 Paice et al.
5,652,688 A * 7/1997 Lee ..... 361/13
5,933,304 A * 8/1999 Irissou ..... 361/13

FOREIGN PATENT DOCUMENTS

| | | |
|---|---|---|
| DE | 42 44 116 | 3/1994 |
| EP | 0 660 348 | 6/1995 |
| FR | 2 525 386 | 10/1983 |
| FR | 2 579 007 | 9/1986 |
| GB | 2 185 856 | 7/1987 |

* cited by examiner

*Primary Examiner*—Brian Sircus
*Assistant Examiner*—Isabel Rodriguez
(74) *Attorney, Agent, or Firm*—Oblon, Spivak, McClelland, Maier & Neustadt, P.C.

(57) ABSTRACT

An electromechanical relay including a mechanical displacement electrical contact and a transistor parallel-connected with the electrical contact. The contact is closed for a voltage V corresponding to the forward direction of the transistor and a powering-on of the transistor that starts before the closure of the contact and ends after the closure. The contact is opened for a voltage V corresponding to the forward direction of the transistor and a powering-on of the transistor that starts before the closure of the contact and ends after the closure. Such an electromechanical relay may find particular application to electromechanical switches, hybrid relays.

14 Claims, 3 Drawing Sheets t
Vc
Dv
17
14
15
t0
T
tv1
tv2
tv3
tv4
tv5
t1
t2
tc
dTC2
dT1
dTR1
Dc1 t
Vc
Di
17
14
15
t10
ti1
ti2
ti3
ti4
t15
t11
t12
dTC4
dT2
dTR3
Dc2

SEMICONDUCTOR SWITCH-ASSISTED ELECTROMECHANICAL RELAY

BACKGROUND OF THE INVENTION

1. Field of the Invention

The invention relates to an electromechanical relay with semiconductor-assisted switching. The relay, designed for the selection switching of charges on an electrical network, can be used for this purpose on either an AC or a DC electrical network.

2. Discussions the Background

Electromechanical type relays have one or more mechanical displacement electrical contacts coupled to a mobile element of the magnetic circuit of an electromagnet. The electromagnet is controlled by supplying power to its coil which, by producing an induction flux in the magnetic circuit, drives the movement of the mobile element and the closing or opening of the electrical contacts of the relay.

The electrical contact usually comprises a fixed part and a mobile part, each having pads made of material that is a good electrical and thermal conductor. These pads, which are brought into contact when the relay is closed, must have low contact resistance in order to limit heating during the passage of the current.

The selection switching, by an electromechanical relay, of an electrical circuit under load, especially when the circuit is inductive, produces arcs between the contacts when the circuit is opened or closed. This phenomenon is commonly called sparking.

Indeed, when the closing of the relay is activated, the current is set up in the electrical current through the electrical contact, producing one or more electrical arcs due to rebounds between the mobile contact and the fixed contact.

At opening, the contact cuts off the current travelling through the electrical circuit. This again produces arcs between the contacts. This intensity increases with the level of the current to be cut off and the inductive character of the circuit.

These repeated arcs inevitably cause deterioration in the contact in the course of time and reduce the life of the contact.

In certain electromechanical relays, in order to limit the arc between the contact terminals during the selection switching, either a triac or two back-to-front parallel-connected thyristors are parallel mounted on the terminals of the mechanical displacement electrical contact. When the contact is being closed, a control circuit makes the triac conductive slightly before the closing of the contact. When the contact is being opened, this control circuit makes the same triac conductive slightly before the opening of the contact.

In this type of hybrid relay comprising a parallel-connected triac (or thyristors) on the mechanical displacement contact, the operation of making the contact conductive slightly before the switching of the contact makes almost all the electrical current flow into the fired triac (or thyristor). The opening or closing of the contact at this time will be done with a current appreciably lower than the current in the electrical circuit. The effective closing of the contact will cause the powering-off of the triac or the thyristors as they are short-circuited by the closed contact.

While these hybrid relays improve the lifetime of the contacts, they do not totally eliminate the arc at the time of the switching. Furthermore, as a result of the elasticity proper to the fixed and mobile parts of the contact, when the contact closes or opens, there are rebounds between this fixed part and this mobile part. Consequently, the closing or opening of the contact does not happen in a single operation.

During a closing of the contact, rebounds at the time of the impact between the mobile part and the fixed part of the contact produce a sequence of repeated opening and closing operations whose number will depend essentially on the mechanical characteristics of the contact. These repeated contact opening and closing operations could produce repeated operations of firing and powering-off of the triac or thyristors that are parallel-connected to the electrical contact, and repeated arcs between the contacts whose intensity will depend on the level of the current in the electrical circuit and on its impedance. These arcs could have a very high level in the case of the selection switching of a circuit comprising self-inductance or capacitive loads.

The phenomenon is as follows (we shall describe the phenomenon in the case of a triac it being known that the same phenomenon occurs for back-to-front parallel-connected thyristors): when the closing of the relay is ordered, the triac is made conducive by the control circuit slightly before the closing of the contact in order to let electrical current into the triac. At the time of the first contact between the mobile part and the fixed part of the contact, the triac that is parallel-connected to the contact gets powered off since the voltage at this terminal is substantially zero. The triac is in the insulated state. All the electrical current passes at this point in time into the closed electrical contact. A first rebound of the contact occurs, causing the opening of the contact crossed by the totality of the current in the electrical circuit and the appearance of a selection switching arc. During a short instant of opening that follows the rebound of the contact, the voltage of the electrical circuit reappears at the terminals of the controlled triac, and this triac again gets refired and again lets through current from the electrical circuit into the triac. The contact closes again at the end of the first rebound, and powers off the triac which once again becomes insulated, prompting the passage of the electrical current into the contact. In the same way, a new rebound will reproduce a new selection switching arc of the terminals of the contact until the rebounds stop and the contact is definitively closed.

In the case of an AC network, when the contact is closed, these repetitive arcs will have an intensity all the greater as the selection switching is done for a current close to the maximum current of alternation of current.

When there is a command for opening the relay, the triac is activated just before the opening of the contact. The triac is short-circuited by the contact, the voltage at its terminals is substantially zero and it remains powered off. The contact is opened with the nominal current in the contact. This current disappears very swiftly when the voltage at the terminals of the triac becomes sufficient to fire it. However, a very brief arc occurs at the time of opening. A rebound produces repetitive arcs, in a manner similar to what happens at the time of closing.

SUMMARY OF THE INVENTION

In order to overcome the drawbacks of the prior art, the invention proposes an electromechanical relay designed to be inserted into an electrical circuit, the relay comprising a mechanical displacement electrical contact, a transistor parallel-connected with the electrical contact, means to command firstly the closing of the contact and the powering-on of the transistor in response to a first control signal and secondly the opening of the contact and the powering-on of the transistor in response to a second control signal, characterized in that the control means comprise means to:

generate, from the first control signal, a mechanical displacement contact closing signal that precedes the closing of the contact, this closure being done for a voltage V at the terminals of the contact that corresponds to the forward direction of the transistor;

generate, from the first control signal, independently of the closing signal, a first signal for powering on the transistor that starts before the closing of the contact and ends after this closing;

generate, from the second control signal, a mechanical displacement contact opening signal that precedes the opening of this contact, this opening being done for a current in the contact corresponding to the forward direction of the transistor;

generate, from the second control signal, independently of the opening signal, a second signal for powering on the transistor that starts before the opening of the contact and ends after this opening.

In a working of the relay according to the invention in a DC network, the transistor is biased constantly in the forward direction so that, during a command for closing or opening the relay, the transistor is powered on some instants before the closing or opening of the contact and the powering on is stopped some instants after the closing or opening of the contact after the end of the rebounds of the contact.

A parallel-connected transistor with the contact of the electromechanical relay according to the invention, when it is powered on in the forward direction, does not get powered off when it is short-circuited by the mechanical displacement contact which has the advantage, as compared with prior art relays using triacs and transistors, of continuing to be conductive during successive openings at the time of the rebounds of the contact. The transistor, which is powered on in the forward direction, totally eliminates the repetitive arcs due to rebounds at each opening of the contact, the current of the electrical circuit instantaneously passing into the transistor.

In one embodiment of the relay according to the invention used in an AC network:

the first signal for powering on the transistor is generated when the voltage V corresponding to the forward direction of the transistor is close to the change in direction of the alternation of the voltage V at its terminals;

the second signal for powering on the transistor is generated when the current corresponding to the forward direction of the transistor is close to the change in direction of the alternation of current in the contact.

In the case of use in an AC network, the fact that the transistor is powered on during a closure of the contact, for a voltage in the forward direction of the transistor that is close to the change in alternation of voltage, namely close to a low voltage as compared with the maximum voltage of the network, means that it is possible to reduce the size of the transistor. Indeed, the current flowing through the transistor during the short period of powering on the transistor (as compared with the period of the AC voltage of the network), will have a low value, the voltage at the terminals of the network being close, at this time, to the change in alternation and therefore having a low value close to zero volts.

In the same way, an opening of the contact for a current in the forward direction close to a change in alternation of current, namely a current close to zero amperes, will mean that the size of the transistor can be reduced.

In the embodiments of the relay according to the invention, the transistor parallel-connected with the electrical contact may be chosen from among the IGBT (insulated gate bipolar transistor) type transistors, bipolar transistors or MOS transistors.

In a variant of the relay according to the invention, the transistor is series-connected with a diode providing protection against reverse voltages at the terminals of the transistors. The protection diode enables the use of the transistor in networks whose voltage is higher than the reverse voltage that can be borne by the transistor, this reverse voltage being borne by the diode.

In one embodiment, the relay according to the invention uses a microcontroller having, firstly, inputs respectively receiving the commands from the relay, a piece of information on current in the electrical circuit and a piece of information on voltage at the terminals of the mechanical displacement electrical contact and, secondly, a control output giving the control signals for opening and closing the contact and an output for powering on the transistor.

BRIEF DESCRIPTION OF THE DRAWINGS

Other features and advantages of the invention shall appear from the following description of an exemplary embodiment of an electromechanical relay, wherein.

DESCRIPTION OF THE PREFERRED EMBODIMENTS

Figure 1:
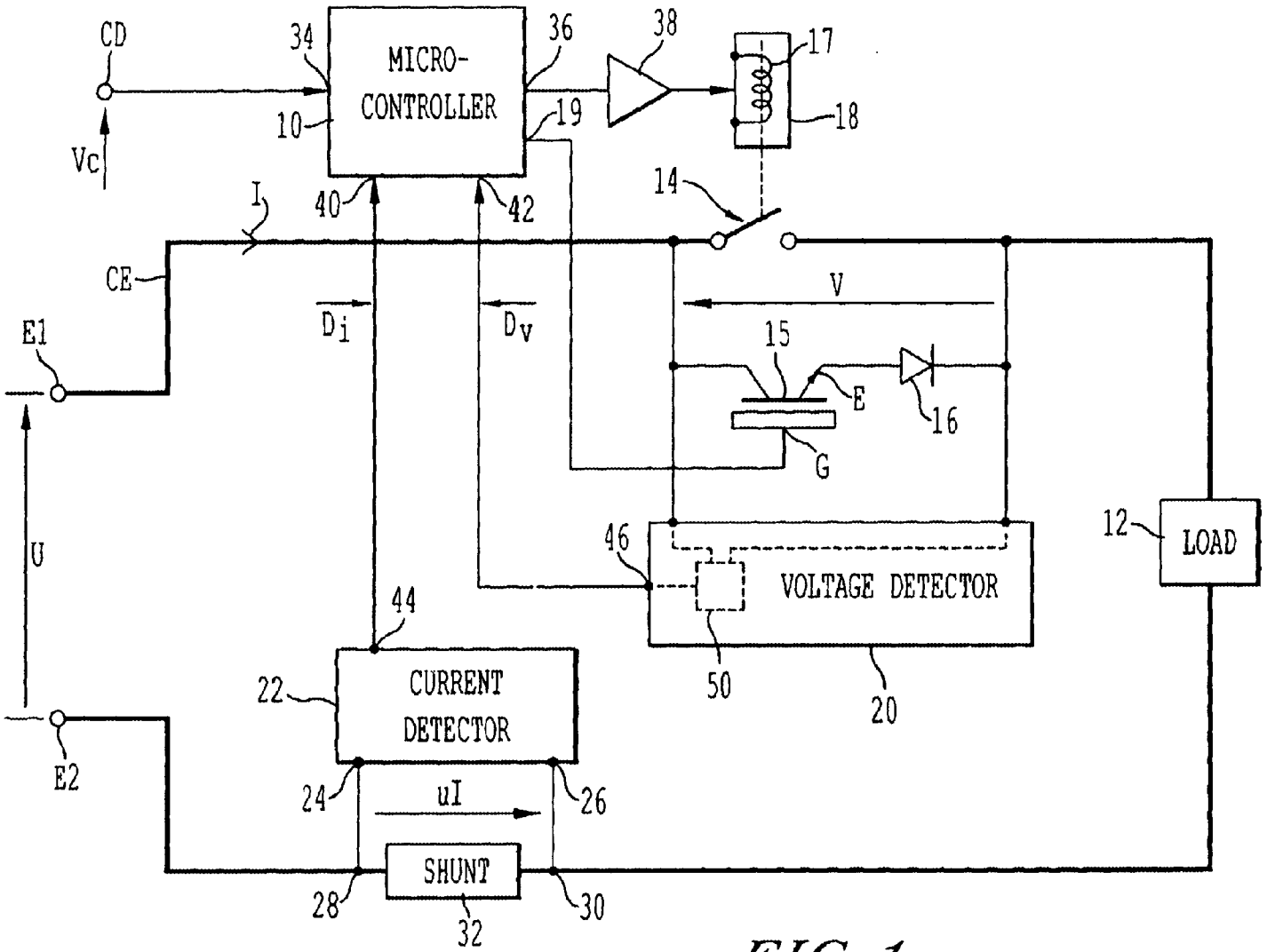
FIG. 1 is a diagrammatic drawing of a relay according to the invention working in an AC network.

FIG. 1 is a diagrammatic drawing of a relay according to the invention inserted into an AC electrical circuit CE with a rated voltage U at its supply terminals E1 and E2.

The electrical circuit CE supplies a load 12 by means of a mechanical displacement electrical contact 14 of the relay. The relay according to the invention essentially comprises a microcontroller 10 providing for the opening and closing of the relay; the mechanical displacement electrical contact 14; an N channel IGBT type transistor 15 series-connected by its emitter E with the anode of a protection diode 16, the assembly formed by the series-connected transistor 15 and diode 16 being parallel-connected to the contact 14 actuated by a coil 17 of an electromagnet 18; a voltage detector 20 of the voltage at the terminals of the contact 14. The microcontroller 10 furthermore comprises a current detector 22 of the current I travelling through the electrical circuit CE and crossing the contact 14 of the relay.

Two inputs 24 and 26 of the current detector 22 are connected to the two terminals 28 and 30 of the shunt 32 series-connected in the electrical circuit CE, the shunt giving a voltage ul at its terminals 28 and 30 that is proportional to the value of the current I in the electrical circuit.

The microcontroller 10 has a logic input 34 connected to a control input CD of the relay, a control output 36 supplying, by means of an amplifier 38, the coil 17 of the electromagnet 18 and a conduction output 19 connected to the control input G of the IGBT type transistor 15.

A current detection input 40 and a voltage detection input 42 of the microcontroller 10 are respectively connected to a current information output 44 of the current detector 22 and a voltage information output 46 of the voltage detector 20.

A first control signal corresponding to a voltage Vc in the low state applied, through the control input CD of the relay, to the logic input 34 of the microcontroller drives the closing of the electrical contact 14 of the relay. A second control signal, corresponding to a voltage Vc in the high state, applied to the same control input CD of the relay, drives the opening of the same contact.

Hereinafter we shall explain the working of the relay by means of the diagram of FIG. 1 and the state graphs corresponding to the states in time of the inputs and outputs of the different elements of the relay.

1) Closing of the relay (See FIGS. 1, 2*a*, 2*b*, 2*c*, 2*d*, 2*e*)

In an initial state before a point in time t0, the voltage Vc applied to the control input CD of the relay is in the low state and the relay is in the open state. In this open state of the relay, the contact 14 is open and the transistor 15 is off, and the potential at the conduction output 19 of the microcontroller 10 is in the low state (close to zero volts).

Figures 2A, 2B, 2C, 2D, 2E:
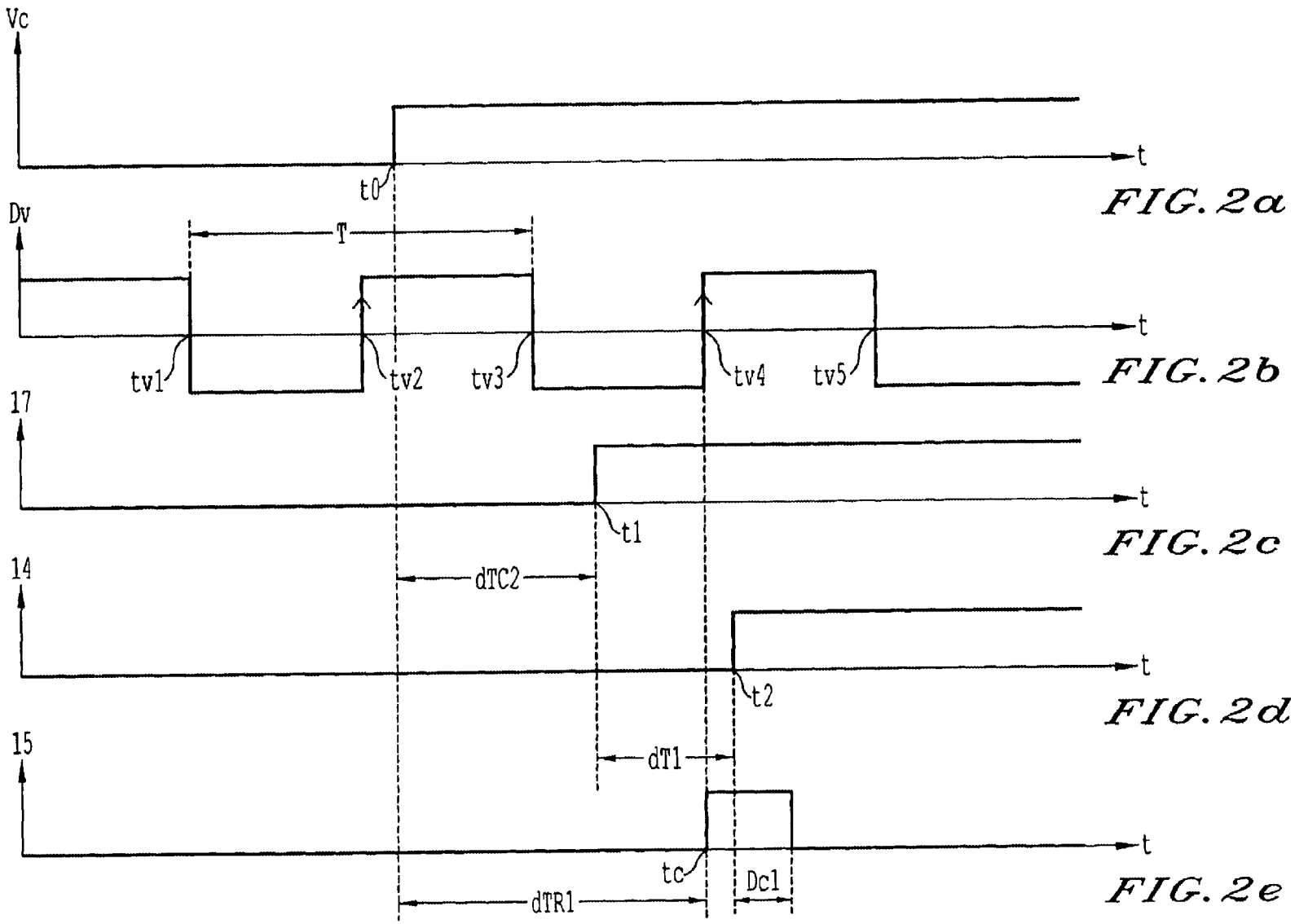
FIGS. 2*a*, 2*b*, 2*c*, 2*d*, 2*e* are state graphs pertaining to the different elements of the relay when the closing is commanded.

FIG. 2*a* shows the logic level control voltage Vc as a function of time. FIG. 2*b* shows the voltage Dv at the voltage information output 46 of the voltage detector 20.

The voltage Dv is in the form of square waves whose leading and trailing edges occur respectively at the points in time tv1, tv2, tv3, tv4, tv5, tvn, corresponding to the changes in the direction of the half waves of the voltage V at the terminals of the contact 14, a leading edge corresponding to the passage from the negative voltage half wave V to the positive voltage half wave V, and a trailing edge representing the reverse. Since the contact 14 is open before the point in time t0, the voltage V at the terminals of the contact is substantially equal to the voltage U of the electrical circuit.

Since the relay is in the open state, it is desired to close it at the point in time to by applying the second control signal to its input CD in the form of a logic level in the high state of the control voltage Vc.

At this instant t0, the control voltage Vc goes from the state 0 (open relay) to the state 1. This logic level at the high state, applied to the control input CD of the relay, is transmitted to the logic input 34 of the microcontroller which activates a sequence of closing the relay.

The voltage detector 20 gives the microcontroller the information on change in alternation enabling it to determine the start of the positive half waves of the voltage U of the electrical network CE corresponding to the forward direction of the N channel type IGBT transistor 15. The microcontroller controls the contact by anticipation so that the selection switching is done in the half wave corresponding to the forward direction of the transistor 15. To this end, the microcontroller, after the appearance of the first relay control signal at the instant t0, computes a first waiting period dTR1 for the generation, at the powering-on output 19 of the microcontroller, of a first powering-on signal producing the saturation of the transistor 15 at the time tc (high state on FIG. 2*e*) in the half wave corresponding to the forward direction of the transistor and at a point in time corresponding to the change in alternation (tv4) of the voltage at the terminals of the contact 14.

The microcontroller 10 computes a second waiting period dTC2 to generate a signal for closing the contact (high state at the control output 36) which, by means of the amplifier 38, powers the control coil 17 (FIG. 2*c*) for the contact 14. The second waiting period dTC2 will be computed so that the contact will be closed at the time t2 shortly after the saturation of the transistor 15. The duration of the first powering-on signal of the transistor will be adjusted by the microcontroller 10 so that the saturation period Dc1 of the transistor 15 after the closing of the contact 14 is sufficient to eliminate the effects of rebounds, if any, of the contact as described above.

The closing signal is shown in FIG. 2*c* by the passage, at the time t1, of the logic output 36 of the microcontroller from the low state (0 in the figure) to the high state (1). The passage to the state 1 of the logic output 36 leads to the powering of the coil 17 of the electromagnet 18 of the relay by means of the amplifier 38 and to the closing of the electrical contact 14 after a closing time dT1 that corresponds to the characteristic delay time of the electromechanical relay between its command at the instant t1 (power supply to the coil 17) and the closing of the electrical contact at a following instant t2.

Let Vmax be the maximum voltage at the terminals of the open contact 14 and Vϵ the voltage at the terminals of the same contact at the time of its closing at the instant t2, the transistor 15 being, at this point in time t2, in the saturated state (or conductive state). The voltage Vϵ will be the saturation voltage of the transistor 15 namely about 2.1 volts, a very low value as compared with the maximum voltage Vmax at the terminals of the contact.

The closing of the contact with very low voltage Vϵ at its terminals produces practically no electrical arc between the contacts when current is set up in the contact.

2) Opening of the relay (See FIGS. 1, 3*a*, 3*b*, 3*c*, 3*d* and 3*e*)

Figures 3A, 3B, 3C, 3D, 3E:
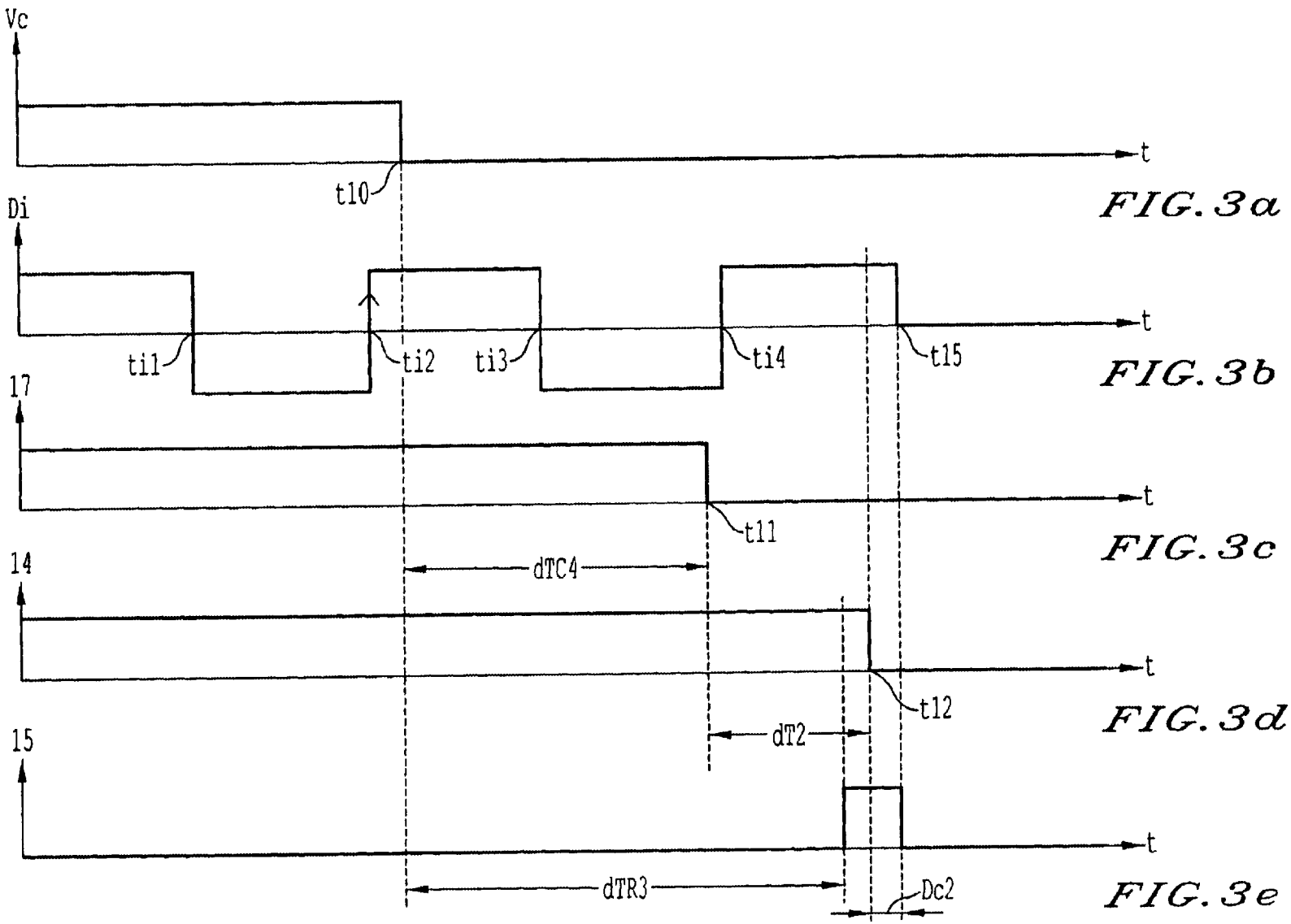
FIGS. 3*a*, 3*b*, 3*c*, 3*d*, 3*e* are state graphs pertaining to the different elements of the relay when the opening is commanded.

In an initial state before the time t10, the relay is in the closed state, the voltage Vc applied to the control input CD of the relay being in the high state. FIG. 3*a* shows the logic level control voltage Vc as a function of time. FIG. 3*b* shows the voltage Di at the current information output 44 of the current detector 20.

With the contact closed, the current of the electrical circuit flows through the contact 14, and the shunt 32 gives the microcontroller the current information corresponding to Di.

The voltage Di is in the form of square waves whose leading and trailing edges occur respectively at the points in time ti1, ti2, ti3, ti4, ti5, . . . , tin, corresponding to the changes in direction of the current half waves I in the electrical circuit, a leading edge corresponding to the passage from the negative current half wave to the positive current half wave and a trailing edge corresponding to the reverse.

Since the relay is in the closed state, it is opened at the instant t10 by applying the first control signal to its input CD in the form of a logic level of the control voltage Vc in the low state.

At this point in time t10, the control voltage Vc goes from the state 1 (closed relay) to the state 0. This low state logic level is transmitted to the logic input 34 of the microcontroller which activates a sequence of opening the relay.

The current detector 22 gives the microcontroller the half-wave changing information that it can use to determine the starting of the positive half waves of the current in the electrical network CE. The microcontroller controls the contact by anticipation so that the switching is done in the half wave corresponding to the forward direction of the transistor 15. To this end, the microcontroller, after the appearance of the first control signal of the relay of the instant t10, computes a third waiting period dTR3 for the generation, at the powering-on output 19 of the microcontroller, of a second powering-on signal (high state in FIG. 3*e*) producing the saturation of the transistor 15 in the half-wave corresponding to the forward direction of the transistor and at a point in time ti5 close to the change in alternation of the current in the contact 14.

The microcontroller 10 computes a fourth waiting period dTC4 to generate a signal for opening the contact 14 (low state at the control output 36) using the amplifier 38 to interrupt the supply of the control coil of the contact 14. The fourth waiting period dTC4 is computed so that the contact is closed shortly after the saturation of the transistor 15.

The duration of the second signal for powering on the transistor will be set by the microcontroller 10 so that the duration of saturation Dc2 of the transistor 15 after the opening of the contact 14 is sufficient to eliminate the effects of rebounds, if any, of the contact. If the second signal for powering on the IGBT transistor 15 stops shortly after the passage through zero of the current (at the time ti5), the transistor 15 will open naturally at the passage through zero of the current owing to the blocking of the series-mounted diode 16. This prevents disturbances of the network.

The closing signal is shown in FIG. 3*c* by the passage of the logic output 36 of the microcontroller, at the time t11, from the high state (1 in the figure) to the low state (0). The passage of the logic output 36 to the state 0 causes the switching of the supply of the coil 17 of the electromagnet 18 of the relay and the closing of the electrical contact 14 after a closing time dT2 corresponding to the delay time that is characteristic of the electromechanical relay between the time when it is commanded at the instant t1 (switching of the supply of the coil 17) and the opening of the electrical contact at a following instant t12.

Let Imax be the maximum current in the closed contact 14, the current in the same contact at the time of its opening at the instant t12 will disappear very quickly flowing into the saturated transistor and producing no electrical arc when the contact is open.

The relay according to the invention has advantages as compared to the prior art relays among which we may mention the following:

an improvement in the longevity of the contacts that brings it close to the mechanical longevity;

an improvement in performance enabling a reduction in the size of the relay;

the transistor and the diode used could be smaller-sized owing to a short time of use during the switching;

a reduction in the switching noise on the upline network;

a reduction of the acoustic noise owing to the reduction in the size of the relay.

What is claimed is:

1. An electromechanical relay designed to be inserted into an electrical circuit, the relay comprising:

a mechanical displacement electrical contact;

a transistor parallel-connected with the electrical contact;

means for commanding a closing of the contact and a powering-on of the transistor in response to a first control signal and for commanding an opening of the contact and the powering-on of the transistor in response to a second control signal, wherein the means for commanding:

generates, from the first control signal, a mechanical displacement contact closing signal that precedes the closing of the contact, the closing of the contact being done for a voltage V at terminals of the contact that correspond to a forward direction of the transistor, generates, from the first control signal, independently of the closing signal, a first signal for powering on the transistor that starts before the closing of the contact and ends after the closing of the contact, generates, from the second control signal, a mechanical displacement contact opening signal that precedes the opening of the contact, the opening of the contact being done for a current in the contact corresponding to the forward direction of the transistor, and generates, from the second control signal, independently of the opening signal, a second signal for powering on the transistor that starts before the opening of the contact and ends after the opening of the contact, wherein the means for commanding comprises a microcontroller having inputs that respectively receive control commands for the relay, a piece of information on current I in the electrical circuit and a piece of information on voltage V at the terminals of the contact and a control output giving the first and second control signals for opening and closing the contact and an output for powering on the transistor, and wherein the microcontroller has computation means for computing, after an appearance of the first control signal from the relay:

a first waiting period for generating, at the powering-on output of the microcontroller, a first powering-on signal producing a saturation of the transistor in a half-wave corresponding to the forward direction of the transistor and at a point in time close to the change in alternation of the voltage at the terminals of the contact, and second waiting period for generating a signal for closing the contact which, by the amplifier, powers the control coil for the contact, the second waiting period being computed so that the contact will be closed shortly after the saturation of the transistor.

2. The electromechanical relay according to claim 1, wherein when the relay is powered with alternating current:

the first signal for powering on the transistor is generated when the voltage V corresponding to the forward direction of the transistor is close to a change in direction of an alternation of the voltage V at its terminal, and the second signal for powering on the transistor is generated when the current corresponding to the forward direction of the transistor is close to a change in direction of the alternation of current in the contact.

3. The electromechanical relay according to claim 1, wherein the transistor parallel-connected with the electrical contact is chosen from among IGBT type transistors, bipolar transistors or MOS transistors.

4. The electromechanical relay according to claim 1, wherein the transistor is series-connected with a diode for protection against reverse voltages at terminals of the transistor.

5. The electromechanical relay according to claim 1, wherein the transistor is an N channel IGBT type transistor, the transistor is series-connected by an emitter of the transistor with an anode of the protection diode, an assembly formed by the transistor and the diode in series being parallel-connected to the contact, and the contact being actuated by a coil of an electromagnet.

6. The electromechanical relay according to claim 5, further comprising:

a voltage detector for detecting the voltage V at the terminals of the contact;

a current detector for detecting the current I crossing the electrical circuit and crossing the contact, two inputs of the current detector being connected to two terminals of a shunt in series in the electrical circuit, the shunt giving, at its terminals, a voltage proportional to a value of the current I in the electrical circuit, wherein the microcontroller includes a logic input connected to a control input of the relay, a control output supplying, by an amplifier, the coil of the electromagnet and a conduction output connected to the gate of the IGBT transistor, and wherein a current detection input and a voltage detection input of the microcontroller is respectively connected to a current information output of the current detector and to a voltage information output of the voltage detector.

7. An electromechanical relay designed to be inserted into an electrical circuit, the relay comprising:

a mechanical displacement electrical contact;

a transistor parallel-connected with the electrical contact;

means for commanding a closing of the contact and a powering-on of the transistor in response to a first control signal and for commanding an opening of the contact and the powering-on of the transistor in response to a second control signal, wherein the means for commanding:

generates, from the first control signal, a mechanical displacement contact closing signal that precedes the closing of the contact, the closing of the contact being done for a voltage V at terminals of the contact that correspond to a forward direction of the transistor, generates, from the first control signal, independently of the closing signal, a first signal for powering on the transistor that starts before the closing of the contact and ends after the closing of the contact, generates, from the second control signal, a mechanical displacement contact opening signal that precedes the opening of the contact, the opening of the contact being done for a current in the contact corresponding to the forward direction of the transistor, and generates, from the second control signal, independently of the opening signal, a second signal for powering on the transistor that starts before the opening of the contact and ends after the opening of the contact, wherein the means for commanding comprises a microcontroller having inputs that respectively receive control commands for the relay, a piece of information on current I in the electrical circuit and a piece of information on voltage V at the terminals of the mechanical displacement electrical contact and a control output giving the first and second control signals for opening and closing the contact and an output for powering on the transistor, and wherein the microcontroller has computation means for computing, after an appearance of the first command from the relay:

a third waiting period for generating, at the powering-on output of the microcontroller, a second powering-on signal producing a saturation of the transistor in a half-wave corresponding to the forward direction of the transistor and at a point in time close to the change in alternation of the current in the contact, and a fourth waiting period for generating a signal for opening the contact using the amplifier to interrupt the supply of the control coil, the fourth waiting period being computed so that the contact is closed shortly after the saturation of the transistor.

8. The electromechanical relay according to claim 7, wherein when the relay is powered with alternating current:

the first signal for powering on the transistor is generated when the voltage V corresponding to the forward direction of the transistor is close to a change in direction of an alternation of the voltage V at its terminal, and the second signal for powering on the transistor is generated when the current corresponding to the forward direction of the transistor is close to a change in direction of the alternation of current in the contact.

9. The electromechanical relay according to claim 7, wherein the transistor parallel-connected with the electrical contact is chosen from among IGBT type transistors, bipolar transistors or MOS transistors.

10. The electromechanical relay according to claim 7, wherein the transistor is series-connected with a diode for protection against reverse voltages at terminals of the transistor.

11. The electromechanical relay according to claim 7, wherein the transistor is an N channel IGBT type transistor, the transistor is series-connected by an emitter of the transistor with an anode of the protection diode, an assembly formed by the transistor and the diode in series being parallel-connected to the contact, and the contact being actuated by a coil of an electromagnet.

12. The electromechanical relay according to claim 11, further comprising:

a voltage detector for detecting the voltage V at the terminals of the contact;

a current detector for detecting the current I crossing the electrical circuit and crossing the contact, two inputs of the current detector being connected to two terminals of a shunt in series in the electrical circuit, the shunt giving, at its terminals, a voltage proportional to a value of the current I in the electrical circuit, wherein the microcontroller includes a logic input connected to a control input of the relay, a control output supplying, by an amplifier, the coil of the electromagnet and a conduction output connected to the gate of the IGBT transistor, and wherein a current detection input and a voltage detection input of the microcontroller is respectively connected to a current information output of the current detector and to a voltage information output of the voltage detector.

13. An electromechanical relay designed to be inserted into an electrical circuit, the relay comprising:

a mechanical displacement electrical contact;

a transistor parallel-connected with the electrical contact;

a microcontroller configured to command a closing of the contact and a powering-on of the transistor in response to a first control signal and to command an opening of the contact and the powering-on of the transistor in response to a second control signal, wherein the microcontroller:

generates, from the first control signal, a mechanical displacement contact closing signal that precedes the closing of the contact, the closing of the contact being done for a voltage V at terminals of the contact that correspond to a forward direction of the transistor, generates, from the first control signal, independently of the closing signal, a first signal for powering on the transistor that starts before the closing of the contact and ends after the closing of the contact, generates, from the second control signal, a mechanical displacement contact opening signal that precedes the opening of the contact, the opening of the contact being done for a current in the contact corresponding to the forward direction of the transistor, and generates, from the second control signal, independently of the opening signal, a second signal for powering on the transistor that starts before the opening of the contact and ends after the opening of the contact, wherein the the microcontroller has inputs that respectively receive control commands for the relay, a piece of information on current I in the electrical circuit and a piece of information on voltage V at the terminals of the contact and a control output giving the first and second control signals for opening and closing the contact and an output for powering on the transistor, and wherein the microcontroller computes, after an appearance of the first control signal from the relay:

a first waiting period for generating, at the powering-on output of the microcontroller, a first powering-on signal producing a saturation of the transistor in a half-wave corresponding to the forward direction of the transistor and at a point in time close to the change in alternation of the voltage at the terminals of the contact, and second waiting period for generating a signal for closing the contact which, by the amplifier, powers the control coil for the contact, the second waiting period being computed so that the contact will be closed shortly after the saturation of the transistor.

14. An electromechanical relay designed to be inserted into an electrical circuit, the relay comprising:

a mechanical displacement electrical contact;

a transistor parallel-connected with the electrical contact;

a microcontroller configured to control a closing of the contact and a powering-on of the transistor in response to a first control signal and to command an opening of the contact and the powering-on of the transistor in response to a second control signal, wherein the microcontroller:

generates, from the first control signal, a mechanical displacement contact closing signal that precedes the closing of the contact, the closing of the contact being done for a voltage V at terminals of the contact that correspond to a forward direction of the transistor, generates, from the first control signal, independently of the closing signal, a first signal for powering on the transistor that starts before the closing of the contact and ends after the closing of the contact, generates, from the second control signal, a mechanical displacement contact opening signal that precedes the opening of the contact, the opening of the contact being done for a current in the contact corresponding to the forward direction of the transistor, and generates, from the second control signal, independently of the opening signal, a second signal for powering on the transistor that starts before the opening of the contact and ends after the opening of the contact, wherein the microcontroller has inputs that respectively receive control commands for the relay, a piece of information on current I in the electrical circuit and a piece of information on voltage V at the terminals of the mechanical displacement electrical contact and a control output giving the first and second control signals for opening and closing the contact and an output for powering on the transistor, and wherein the microcontroller computes, after an appearance of the first command from the relay:

a third waiting period for generating, at the powering-on output of the microcontroller, a second powering-on signal producing a saturation of the transistor in a half-wave corresponding to the forward direction of the transistor and at a point in time close to the change in alternation of the current in the contact, and a fourth waiting period for generating a signal for opening the contact using the amplifier to interrupt the supply of the control coil, the fourth waiting period being computed so that the contact is closed shortly after the saturation of the transistor.

* * * * *